US009255458B2

(12) United States Patent
Austin et al.

(10) Patent No.: US 9,255,458 B2
(45) Date of Patent: Feb. 9, 2016

(54) METHOD AND SYSTEM FOR SEALING AND HANDLING PIPE

(75) Inventors: John A. Austin, Katy, TX (US); Raymond Christopher Young, Houston, TX (US)

(73) Assignee: Foster Wheeler USA Corporation, Houston, TX (US)

( * ) Notice: Subject to any disclaimer, the term of this patent is extended or adjusted under 35 U.S.C. 154(b) by 655 days.

(21) Appl. No.: 13/597,547

(22) Filed: Aug. 29, 2012

(65) Prior Publication Data

US 2013/0049385 A1 Feb. 28, 2013

Related U.S. Application Data

(60) Provisional application No. 61/528,511, filed on Aug. 29, 2011.

(51) Int. Cl.

| | |
|---|---|
| ***E21B 19/02*** | (2006.01) |
| ***E21B 31/20*** | (2006.01) |
| ***E21B 19/00*** | (2006.01) |

(52) U.S. Cl.

CPC ..... *E21B 31/20* (2013.01); *E21B 19/002* (2013.01); *Y10T 29/49428* (2015.01)

(58) Field of Classification Search

CPC ..... E21B 19/002; E21B 31/20
USPC ..... 294/86.12; 137/315.02
See application file for complete search history.

(56) References Cited

U.S. PATENT DOCUMENTS

| | | | | |
|---|---|---|---|---|
| 2,324,886 | A * | 7/1943 | Sowders | 294/86.12 |
| 3,543,323 | A | 12/1970 | Girard | |
| 3,685,083 | A | 8/1972 | Jones | |
| 3,751,932 | A | 8/1973 | Matthews, Jr. | |
| 3,788,084 | A | 1/1974 | Matthews, Jr. | |
| 4,004,635 | A | 1/1977 | Marquaire et al. | |
| 4,142,739 | A * | 3/1979 | Billingsley | 285/18 |
| 4,389,461 | A | 6/1983 | Scott | |
| 4,543,131 | A | 9/1985 | Purinton, Jr. | |
| 4,662,785 | A | 5/1987 | Gibb et al. | |
| 5,105,888 | A | 4/1992 | Pollock et al. | |
| 5,188,483 | A | 2/1993 | Kopp et al. | |
| 5,868,203 | A | 2/1999 | Cunningham | |
| 6,196,757 | B1 | 3/2001 | Bakke | |
| 6,371,207 | B1 | 4/2002 | Reynolds | |
| 6,527,869 | B1 | 3/2003 | Bourg | |
| 2008/0245528 | A1 | 10/2008 | Stokka et al. | |
| 2009/0307857 | A1 | 12/2009 | Hestenes | |
| 2010/0012151 | A1 | 1/2010 | Baugh et al. | |
| 2010/0089126 | A1 | 4/2010 | Sweeney | |

(Continued)

OTHER PUBLICATIONS

Copenheaver, Blaine R., "International Search Report" prepared for PCT/US2012/052778 as mailed Nov. 13, 2012, 2 pages.

(Continued)

*Primary Examiner* — David Andrews

(74) *Attorney, Agent, or Firm* — Winstead PC

(57) ABSTRACT

In one aspect, the present invention relates to a friction-pin unit. The friction-pin unit includes a sleeve and a guide cone formed at a first end of the sleeve. A shaft is disposed coaxially within the sleeve and a plurality of friction pins extend radially outward from the shaft. The plurality of friction pins are adapted for interference-fit engagement with an inner surface of the pipe. A ring seal is circumferentially disposed around an inner surface of the sleeve. The ring seal adapted to circumferentially seal an outer surface of the pipe.

22 Claims, 7 Drawing Sheets

(56) References Cited

U.S. PATENT DOCUMENTS

| | | | |
|---|---|---|---|
| 2010/0170535 | A1 | 7/2010 | Freeman et al. |
| 2013/0199651 | A1 | 8/2013 | Bowie |
| 2014/0060678 | A1 | 3/2014 | Austin et al. |

OTHER PUBLICATIONS

Thomas, Shane, "International Search Report" prepared for PCT/US2013/057004 as mailed Jan. 29, 2014, 3 pages.

* cited by examiner

METHOD AND SYSTEM FOR SEALING AND HANDLING PIPE

CROSS-REFERENCE TO RELATED APPLICATIONS

This application claims priority to, and incorporates by reference the entire disclosure of, U.S. Provisional Patent Application No. 61/528,511, filed Aug. 29, 2011.

BACKGROUND

1. Field of the Invention

The present invention relates to systems and methods for engaging and handling pipe and more particularly, but not by way of limitation, to systems and methods for engaging and handling pipe associated with an offshore petroleum well via an interference engagement with the pipe.

2. History of the Related Art

The discovery, development, and production of petroleum wells that lie underwater, known as offshore petroleum production, has become increasingly significant. Offshore petroleum production allows access to deposits of, for example, oil and gas that might otherwise be unreachable through conventional land-based petroleum production. Offshore petroleum production is considerably more challenging than land-based petroleum production due to harsh environmental conditions. For example, an ocean depth often increases a length of a fluid column associated with an offshore well by several hundred meters. The longer fluid column increases downhole pressures associated with the offshore well and substantially increases a magnitude of energy required to lift produced fluids from an ocean floor to a drilling platform. During offshore petroleum production, sections of pipe are frequently lost on the ocean floor. Sections of lost pipe are frequently unrecoverable using conventional techniques and, thus, represent a significant loss to a company engaged in offshore exploration. In addition, pipelines and flowlines, for transporting petroleum products may become damaged due to, for example, an anchor of an ocean vessel. In this situation, sections of damaged or otherwise abandoned pipeline or flowline will need to be recovered.

In offshore petroleum production, a riser pipe is typically constructed between a top of a well bore, located on the ocean floor, and a drilling platform located above the water surface. The riser pipe acts as a guide for a drill string between the drilling platform and the well bore. The riser pipe also conducts drilling fluid between the well bore and the drilling platform. The riser pipe is typically constructed of several sections of pipe and may, in some cases, include specialized equipment to compensate for movement of the drilling platform due, for example, to ocean currents.

Offshore petroleum production also involves environmental hazards. The most notable environmental hazard is risk of spillage of petroleum products from tanker ships or from pipelines transporting the petroleum products to onshore sites. Spillage of petroleum products can also result from damaged equipment associated with the drilling platform. Situations involving equipment damage or leaks on the ocean floor, such as, for example, damage to a riser pipe, can be particularly catastrophic and difficult to manage. As evidenced by the April 2010 Deepwater Horizon disaster in the Gulf of Mexico, the ability to quickly and effectively seal a damaged undersea riser pipe is critical to the ongoing safe operation of offshore petroleum wells.

SUMMARY

The present invention relates to systems and methods for engaging and handling pipe. In one aspect, the present invention relates to a friction-pin unit for engagement with a pipe. The friction-pin unit includes a sleeve and a guide cone formed at a first end of the sleeve. A shaft is disposed coaxially within the sleeve and a plurality of friction pins extend radially outward from the shaft. The plurality of friction pins are adapted for interference-fit engagement with an inner surface of the pipe. A ring seal is circumferentially disposed around an inner surface of the sleeve. The ring seal adapted to circumferentially seal an outer surface of the pipe.

In another aspect, the present invention relates to a method for sealing a pipe. The method includes positioning a friction-pin unit above the pipe. The friction-pin unit comprising a sleeve, a guide cone formed at a first end of the sleeve, and a shaft disposed coaxially within the sleeve. A plurality of friction pins extend radially outward from the shaft. A ring seal is circumferentially disposed around an inner surface of the sleeve. The method further includes engaging the pipe with the guide cone and lowering the friction-pin unit such that the sleeve surrounds the pipe and the shaft extends into an interior of the pipe. The plurality of friction pins interferingly engage the inner surface of the pipe. The ring seal engages an outer surface of the pipe.

In another aspect, the present invention relates to a method of handling a pipe. The method includes positioning a friction-pin unit near the pipe. The friction-pin unit includes a sleeve and a shaft disposed coaxially within the sleeve. A plurality of friction pins extend radially outward from the shaft. A ring seal is circumferentially disposed around an inner surface of the sleeve and an insertion guide formed at a first end of the sleeve. The insertion guide includes a portion of the shaft that extends beyond the sleeve. The method further includes engaging the pipe with the insertion guide such that the sleeve surrounds the pipe and the shaft extends into an interior space of the pipe. The plurality of friction pins interferingly engage the inner surface of the pipe. The pipe is handled in a desired manner.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

A more complete understanding of the method and system of the present invention may be obtained by reference to the following Detailed Description when taken in conjunction with the accompanying drawings wherein.

DETAILED DESCRIPTION

Figure 1:
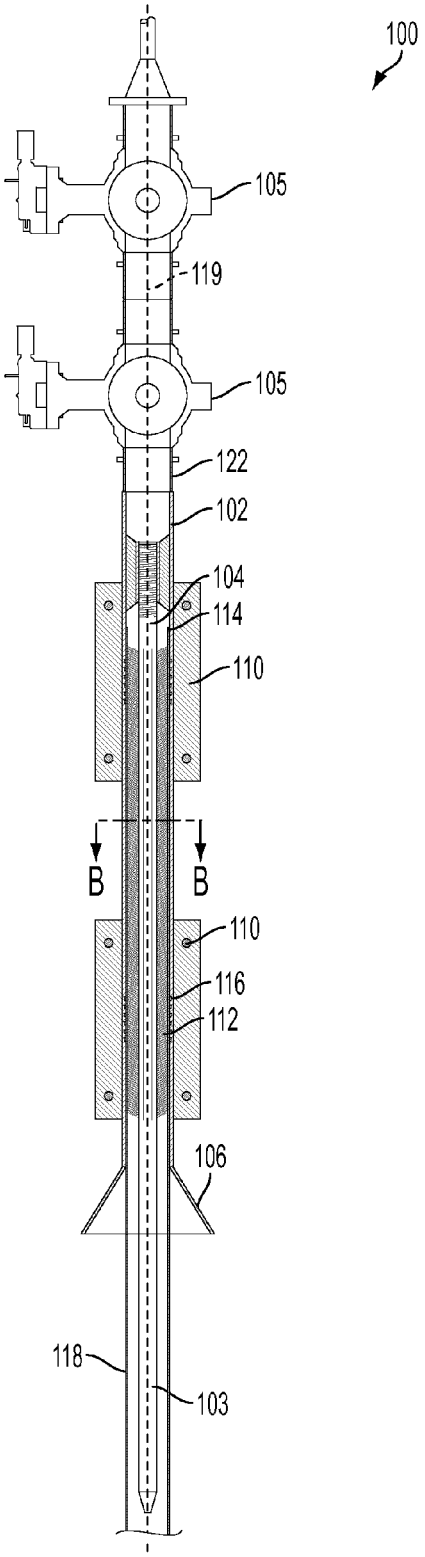
FIG. 1 is a side cross-sectional view of a friction-pin unit.

Various embodiments of the present invention will now be described more fully with reference to the accompanying drawings. Like reference numerals are utilized to reference like components. The invention may, however, be embodied in many different forms and should not be construed as limited to the embodiments set forth herein.

FIG. 1 is a side cross-sectional view of a friction-pin unit 100. The friction-pin unit 100 includes a sleeve 102 having a vertical axis 119. In a typical embodiment, the sleeve 102 has an inner diameter that is slightly larger than an outer diameter of a pipe 118, such as, for example, a damaged sub-sea riser pipe. In a typical embodiment, a slip-fit engagement is present between the sleeve 102 and the pipe 118. A guide cone 106 is formed on a bottom aspect of the sleeve 102. In a typical embodiment, the guide cone 106 is integrally formed with the sleeve 102; however, in other embodiments, the guide cone 106 may be joined to the sleeve 102 through a process such as, for example, welding. A stop ring 114 and at least one ring seal 116 are circumferentially disposed about an interior surface of the sleeve 102. In a typical embodiment, the stop ring 114 is disposed near a top end 122 of the sleeve 102 and the at least one ring seal 116 is disposed below the stop ring 114 relative to the sleeve 102. A plurality of handling flanges 110 are formed on an exterior surface of the sleeve 102. In a typical embodiment, the sleeve 102 is constructed of high-strength material such as, for example, 75KSI steel.

A shaft 104 is disposed within the sleeve 102 in a coaxial fashion relative to the sleeve 102. A plurality of friction pins 112 extend from the shaft 104 in a radial configuration. A portion of the shaft 104 extends below the guide cone 106 and forms an insertion guide 103. The insertion guide 103 aids in centering the friction-pin unit 100 over a pipe 118. In a typical embodiment, the shaft 104 is approximately 8⅜ inches in diameter; however, any size of the shaft 104 may be utilized as dictated by design requirements. In a typical embodiment, the shaft 104 is constructed of a high-strength material such as, for example, 75KSI steel; however, any appropriate high-strength material may be utilized. In a typical embodiment, the pipe 118 is, for example, a damaged sub-sea riser pipe.

A valve 105 is disposed at a top end 122 of the sleeve 102. In a typical embodiment, the valve 105 is fluidly coupled to an interior region bounded by the interior surface of the sleeve 102. The valve 105 allows passage of fluid and relief of pressure from the interior region to an exterior environment. Relief of pressure reduces a downward force required to install the friction-pin unit 100 on the pipe 118. In a typical embodiment, the valve 105 is a full-bore ball valve; however, in various other embodiments, valve designs such as, for example, a gate valve, may be utilized.

Figure 2:
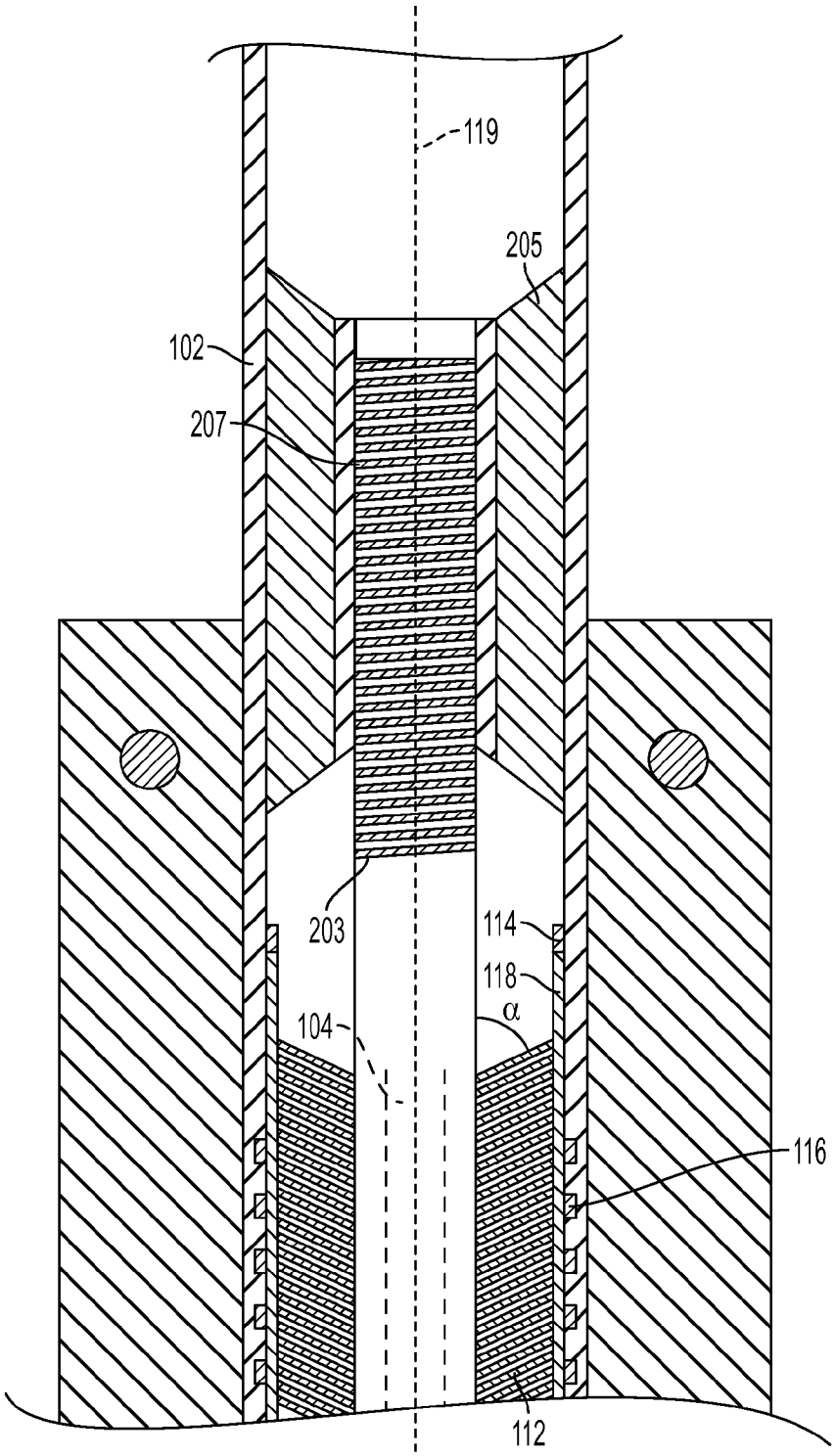
FIG. 2 is an enlarged cross-sectional view of Detail A of the friction-pin unit of FIG. 1.

FIG. 2 is an enlarged cross-sectional view of Detail A of the friction-pin unit 100. Threads 203 formed on an exterior surface of an upper end of the shaft 104 engage a threaded sleeve 207 disposed within the sleeve 102. The threaded sleeve 207 is fixed within the sleeve 102 by a plurality of flanges 205. In a typical embodiment, each flange of the plurality of flanges 205 is a vertically-oriented web that extends inwardly from the interior surface of the sleeve 102 toward the threaded sleeve 207. Channels (not explicitly shown) are formed between adjacent flanges of the plurality of flanges 205. Fluid present within the sleeve 102 is able to pass through the channels. Thus, the plurality of flanges 205 do not restrict movement of fluids within the sleeve 102.

The plurality of friction pins 112 are secured to, and extend outwardly from, the shaft 104 in a radial fashion. In a typical embodiment, the friction pins 112 are attached to the shaft 104 via a thermal or mechanical press-fit engagement. For example, in the case of a thermal press-fit engagement, the plurality of friction pins 112 are inserted into a plurality of thermally expanded holes (not shown) in the shaft 104. Upon cooling of the shaft 104, the plurality of holes contracts and forms an interference engagement with the plurality of friction pins 112. The plurality of friction pins 112 may be of any size or arrangement as dictated by design requirements. A length and a cross-sectional shape of the plurality of friction pins 112 varies with the diameter of the pipe 118 and with design requirements. For example, if the pipe 118 has a diameter of approximately 10 inches, the plurality of friction pins 112 may have a diameter of approximately ⅜", a length of approximately 6" and are disposed at an angle ($\alpha$) of approximately 34.5 degrees from the vertical axis 119 of the friction-pin unit 100.

In an illustrative embodiment, the friction pins 112 are arranged in six columns of approximately 220 pins; however, any number of columns and any number of friction pins may be utilized. For example, friction pin units utilizing principles of the invention may include an integer number of the friction pins 112 between 1 and approximately 100,000. Likewise, friction pin units utilizing principles of the invention may be arranged in an integer number of columns of the friction pins 112 between 1 and approximately 100. In other embodiments, different arrangements of the friction pins 112 may be employed, such as, for example, a staggered arrangement, a spiral arrangement, or a concentric-circle arrangement. In a typical embodiment, the plurality of friction pins 112 are constructed of a high-strength material such as, for example, 75KSI steel; however, in other embodiments, other high-strength materials may be utilized. The stop ring 114 is circumferentially disposed about the interior surface of the sleeve 102. In a typical embodiment, the stop ring 114 engages a top aspect of the pipe 118 and prevents further downward movement of the friction-pin unit 100 along the vertical axis 119. The at least one ring seal 116 is circumferentially disposed about the interior surface of the sleeve 102. During operation, the at least one ring seal 116 circumferentially engages an outer surface of the pipe 118 and forms a seal between the pipe 118 and the sleeve 102 so as to impede leakage of fluids from the sleeve 102 into the exterior environment.

Figure 3:
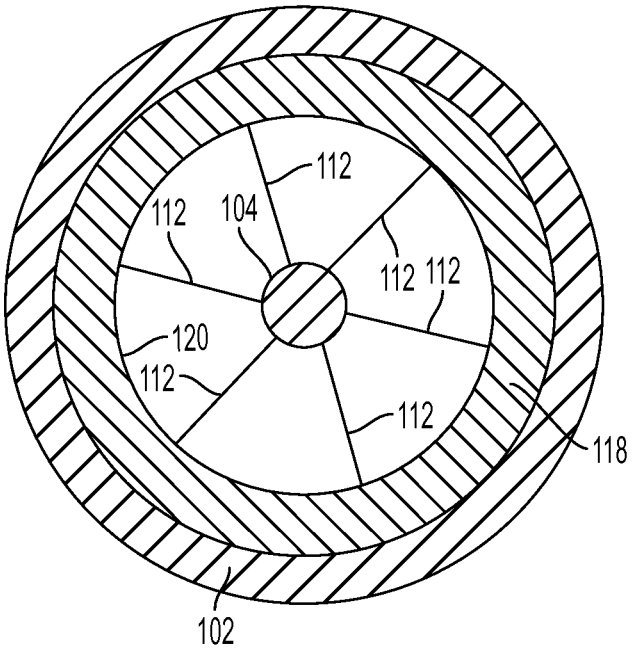
FIG. 3 is a cross-sectional view, about line B-B, of the friction-pin unit of FIG. 1.

FIG. 3 is a cross-sectional view, about line B-B, of the friction-pin unit 100. During operation, the sleeve 102 is placed around an exposed end of the pipe 118. The shaft 104 and the plurality of friction pins 112 extend into an interior space of the pipe 118. An inner surface 120 of the pipe 118 causes the plurality of friction pins 112 to flex in a direction towards the top end 122 of the sleeve 102. Flexing of the plurality of friction pins 112 results in the plurality of friction pins 112 being spring-biased towards the inner surface 120. The plurality of friction pins 112 engage an inner surface 120 of the pipe 118 and create an interference fit between the friction-pin unit 100 and the inner surface 120. For example, if the pipe 118 has a diameter of approximately 10 inches, the plurality of friction pins 112 flex by approximately 0.5 degrees to approximately 2.0 degrees; however, the degree of flexion of the plurality of friction pins 112 varies depending on the diameter of the pipe 118 and design requirements. The interference fit secures the friction-pin unit 100 in place relative to the pipe 118 and prevents the friction-pin unit 100 from becoming disengaged from the pipe 118. In a typical embodiment, the friction-pin unit 100 resists, for example, approximately 5,000 psi (1475 kips) of fluid-head pressure within the pipe 118. In other embodiments, the shaft 104 may include a plurality of shaft segments (not shown). In such an embodiment, additional shaft segments may be added to increase a length of the shaft 104 and increase pressure capacity of the friction-pin unit 100.

Figure 4:
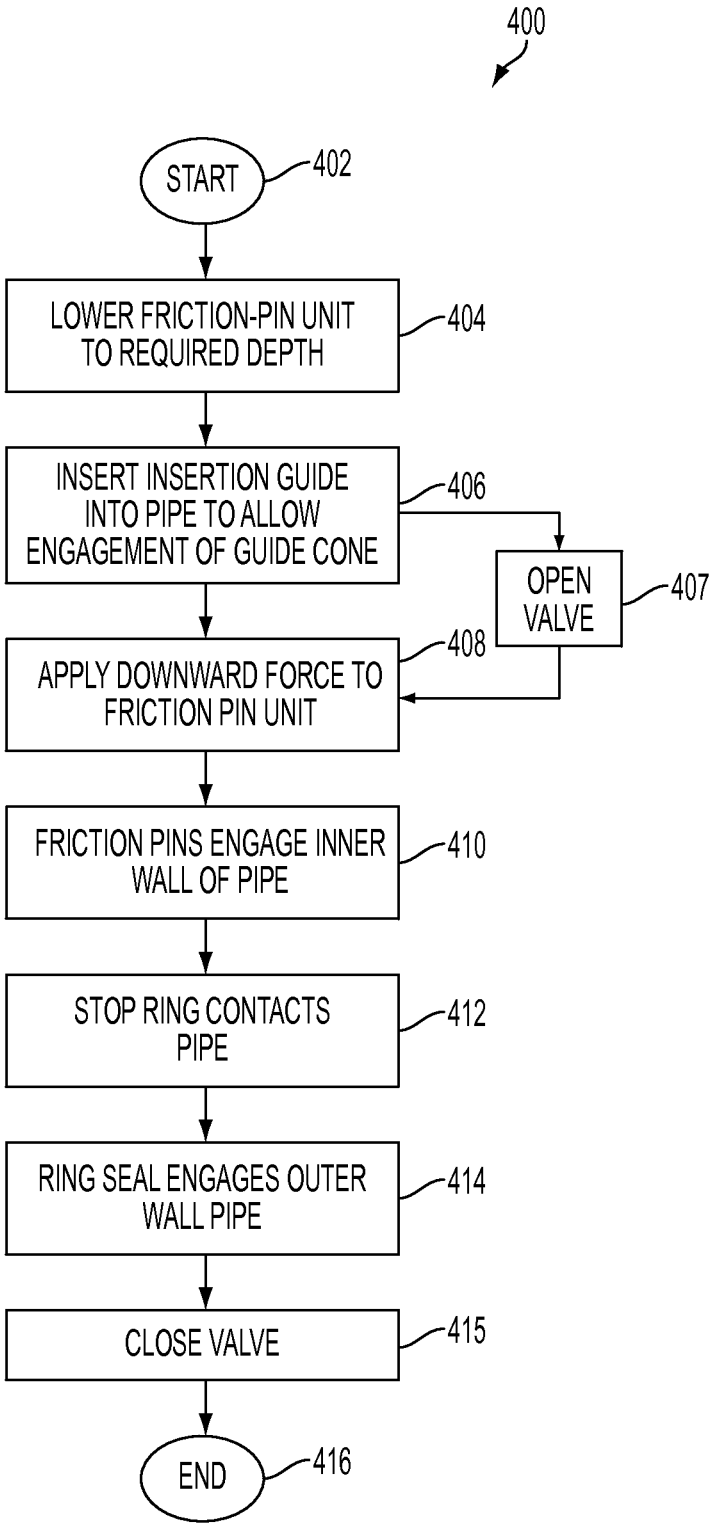
FIG. 4 is a flow diagram of a process for sealing a pipe.

FIG. 4 is a flow diagram of a process for sealing a pipe. A process 400 starts at step 402. At step 404, the friction-pin unit 100 is lowered via, for example, a drill string from a water surface. At step 406, the insertion guide 103 is inserted into an exposed end of the pipe 118. In a typical embodiment, the pipe 118 is, for example, a damaged riser pipe. The guide cone 106 causes the friction-pin unit 100 to self-center above the pipe 118. At step 407, the valve 105 is placed in an open position. At step 408, a downward force sufficient to overcome fluid and mechanical resistance is applied to the friction-pin unit 100. The downward force causes the friction-pin unit 100 to be lowered such that the sleeve 102 envelops the pipe 118 and the shaft 104 extends further into an interior space of the pipe 118. The valve 105, when in an open position, serves to lessen pressure build-up within the friction-pin unit 100 and reduces a required magnitude of the downward force.

At step 410, the plurality of friction pins 112 engage the inner surface 120 of the pipe 118 and create an interference fit between the friction-pin unit 100 and the inner surface 120. At step 412, the stop ring 114 contacts a top of the pipe and prevents further downward movement of the friction-pin unit 100 relative to the pipe 118. At step 414, the at least one ring seal 116 circumferentially engages the outer surface of the pipe 118 and create a seal between the sleeve 102 and the pipe 118 that impedes leakage of fluids into the exterior environment. At step 415, the valve 105 is closed so as to impede leakage of fluids into the exterior environment. In a typical embodiment, the valve 105 is closed, for example, by a remote-operated vehicle. The process 400 ends at step 416. One skilled in the art will appreciate that, in various other embodiments, one or more of the above-listed steps may be performed simultaneously in whole or in part or in a different order from that described above.

Figure 5:
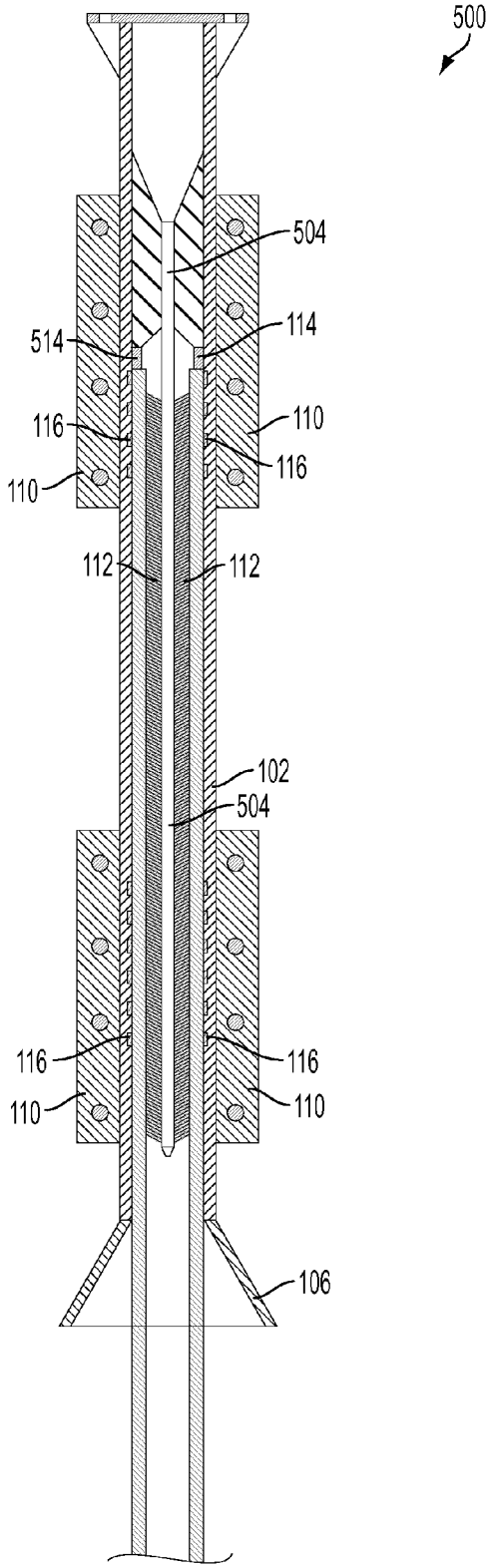
FIG. 5 is a side cross-sectional view of a friction-pin unit without a valve.

FIG. 5 is a side cross-sectional view of a friction-pin unit 500. The friction-pin unit 500 includes the sleeve 102. The guide cone 106 is formed on a bottom aspect of the sleeve 102. The stop ring 114 and the at least one ring seal 116 are disposed circumferentially about an interior surface of the sleeve 102. The shaft 504 is disposed in the sleeve 102 in a coaxial fashion. The plurality of friction pins 112 extend from the shaft 504 in a radial configuration. Thus, the friction-pin unit 500 is similar in construction to the friction-pin unit 100 (shown in FIG. 1); however the friction-pin unit 500 omits the valve 105 and the insertion guide 103 shown in FIG. 1.

Figure 6:
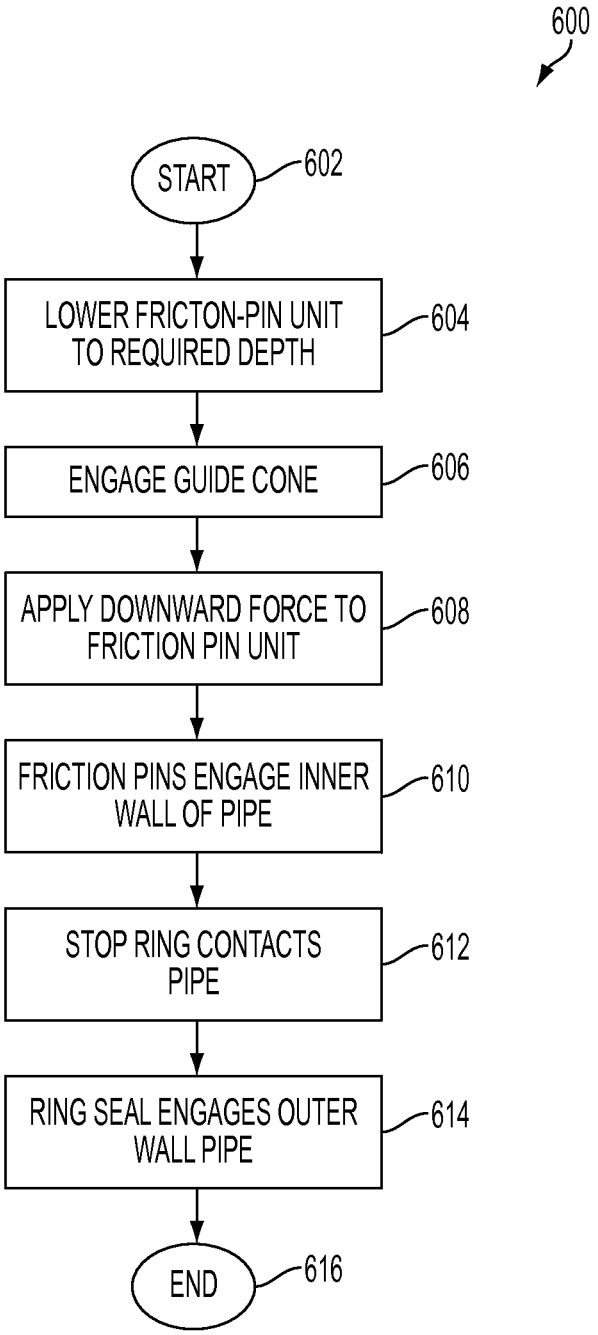
FIG. 6 is a flow diagram of a process for sealing a pipe.

FIG. 6 is a flow diagram of a process for sealing a pipe. A process 600 starts at step 602. At step 604, the friction-pin unit 500 is lowered into position via the plurality of handling flanges 110. At step 606, an exposed end of the pipe 118 is engaged by the guide cone 106. The guide cone 106 causes the friction-pin unit 500 to self-center above the pipe 118. At step 608, a downward force sufficient to overcome fluid and mechanical resistance is applied to the friction-pin unit 500. The downward force causes the friction-pin unit 500 to move in a downward direction relative to the pipe 118 such that the sleeve 102 envelops the pipe 118 and the shaft 504 extends into an interior of the pipe 118.

At step 610, the plurality of friction pins 112 engage an inner surface 120 of the pipe 118 and create an interference fit between the friction-pin unit 500 and the inner surface 120. At step 612, the stop ring 114 contacts a top region of the pipe 118. The stop ring 114 prevents further downward movement of the friction-pin unit 500 relative to the pipe 118. At step 614, the at least one ring seal 116 circumferentially engages the outer surface of the pipe 118 and forms a seal between the sleeve 102 and the pipe 118 so as to impede leakage of fluids into the exterior environment. The process 600 ends at step 616. One skilled in the art will appreciate that, in various other embodiments, one or more of the above-listed steps may be performed simultaneously in whole or in part or in a different order from that described above.

Figure 7:
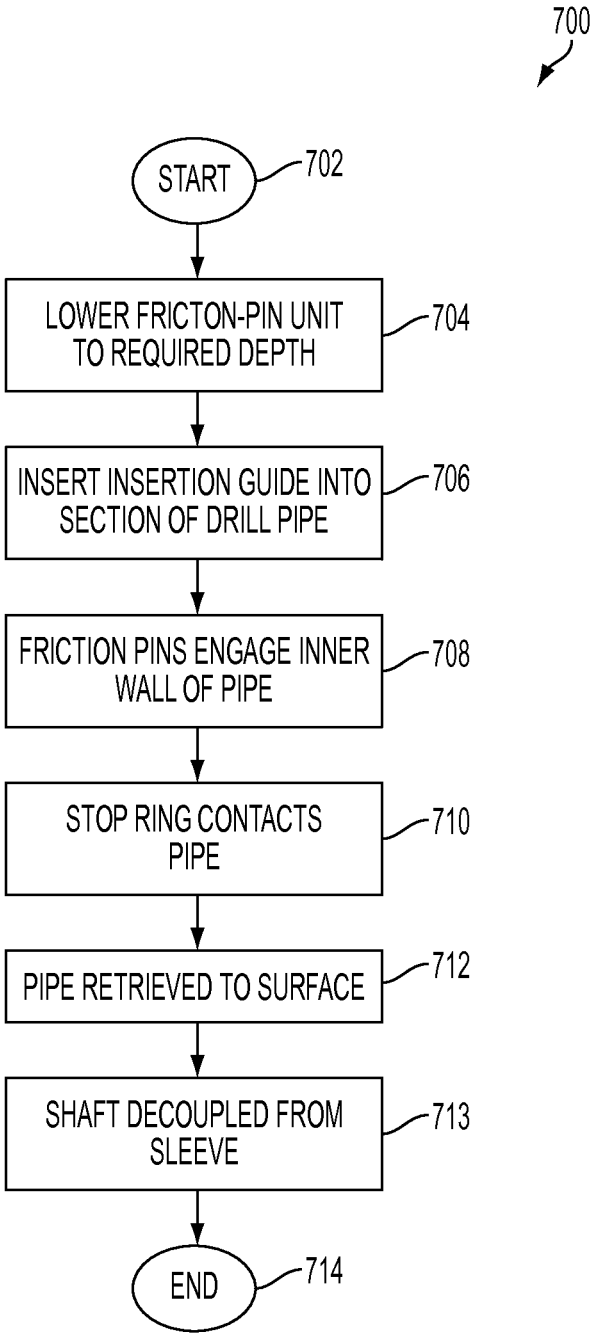
FIG. 7 is a flow diagram for handling a pipe.

FIG. 7 is a flow diagram for handling a pipe. In a typical embodiment, the pipe may be a damaged riser pipe, such as, for example, the pipe 118. In other embodiments, the pipe 118 may be components of, for example, an abandoned or damaged pipeline or flowline. A process 700 begins at step 702. At step 704, a friction-pin unit such as, for example, the friction-pin unit 100, is lowered to a required depth via, for example, a crane or a drill string. At step 706, the insertion guide 103 is inserted into the pipe. At step 708, the plurality of friction pins 112 engage an inner surface of the pipe and create an interference fit between the friction-pin unit 100 and the inner surface of the pipe. At step 710, the stop ring 114 contacts the pipe. The stop ring 114 prevents further movement of the friction-pin unit 100 relative to the pipe. At step 712, the pipe is handled in a desired manner. For example, the pipe may be retrieved to an ocean surface via, for example, a crane. At step 713, the shaft 104 is decoupled from the sleeve 102. In a typical embodiment, the shaft 104 is decoupled from the sleeve 102 via disengagement of the threads 203 from the threaded sleeve 207. Decoupling of the shaft 104 from the sleeve 102 allows the sleeve 102 to be removed from the pipe and facilitates removal of the shaft 104 from the pipe.

In a typical embodiment, the shaft 104 is removed from the pipe via a tool such as, for example, a ram or press. The process 700 ends at step 714. One skilled in the art will appreciate that, in various other embodiments, one or more of the above-listed steps may be performed simultaneously in whole or in part or in a different order from that described above. While the process 700 has been described above with respect to the friction-pin unit 100, one skilled in the art will recognize that, in other embodiments, the process 700 may utilize other friction-pin units utilizing principles of the invention, such as, for example, the friction-pin unit 500.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A friction-pin unit for engagement with a pipe comprising:

a sleeve;

a guide cone formed at a first end of the sleeve;

a shaft disposed coaxially within the sleeve;

a plurality of friction pins extending radially outward from the shaft, the plurality of friction pins being adapted for interference-fit engagement with an inner surface of the pipe; and a ring seal circumferentially disposed around an inner surface of the sleeve, the ring seal adapted to circumferentially seal an outer surface of the pipe.

2. The friction-pin unit of claim 1, comprising a valve disposed at a second end of the sleeve.

3. The friction-pin unit of claim 2, wherein the valve relieves pressure from fluid in an interior region bounded by the sleeve.

4. The friction-pin unit of claim 1, comprising an insertion guide comprising a portion of the shaft that extends beyond the guide cone.

5. The friction-pin unit of claim 1, comprising a stop ring circumferentially disposed about the inner surface of the sleeve, the stop ring engaging a top surface of the pipe to prevent further downward movement of the friction-pin unit relative to the pipe.

6. The friction-pin unit of claim 1, wherein the plurality of friction pins are disposed at an angle of approximately 34.5 degrees from the shaft.

7. The friction-pin unit of claim 1, comprising a plurality of handling flanges disposed on an exterior surface of the sleeve and arranged generally parallel to the shaft.

8. A method of sealing a pipe, the method comprising:

positioning a friction-pin unit above the pipe, the friction-pin unit comprising:

a sleeve;

a guide cone formed at a first end of the sleeve;

a shaft disposed coaxially within the sleeve;

a plurality of friction pins extending radially outward from the shaft; and a ring seal circumferentially disposed around an inner surface of the sleeve;

engaging the pipe with the guide cone;

lowering the friction-pin unit such that the sleeve surrounds the pipe and the shaft extends into an interior of the pipe;

interferingly engaging the plurality of friction pins with the inner surface of the pipe; and engaging the ring seal with an outer surface of the pipe.

9. The method of claim 8, wherein the positioning comprises utilizing a plurality of handling flanges disposed on an exterior surface of the sleeve.

10. The method of claim 8, wherein the lowering comprises engaging a stop ring circumferentially disposed about the interior surface of the sleeve with a top surface of the pipe.

11. The method of claim 8, comprising relieving, via a valve fluidly coupled to the sleeve, pressure from within the sleeve.

12. The method of claim 11, comprising closing the valve to seal the pipe.

13. The method of claim 8, wherein the plurality of friction pins are disposed at an angle of approximately 34.5 degrees from the shaft.

14. The method of claim 8, wherein two of the steps are performed simultaneously at least in part.

15. The method of claim 8, wherein the steps are performed in the order listed.

16. A method of handling a pipe, the method comprising:

positioning a friction-pin unit proximate the pipe, the friction-pin unit comprising:

a sleeve;

a shaft disposed coaxially within the sleeve;

a plurality of friction pins extending radially outward from the shaft; and a ring seal circumferentially disposed around an inner surface of the sleeve;

an insertion guide formed at a first end of the sleeve, the insertion guide comprising a portion of the shaft that extends beyond the sleeve;

engaging the pipe with the insertion guide such that the sleeve surrounds the pipe and the shaft extends into an interior space of the pipe;

interferingly engaging the plurality of friction pins with the inner surface of the pipe; and handling the pipe in a desired manner.

17. The method of claim 16, comprising relieving, via a valve fluidly connected to the sleeve, pressure from within the sleeve.

18. The method of claim 16, wherein the positioning comprises utilizing a plurality of handling flanges disposed on an outer surface of the friction-pin unit.

19. The method of claim 16, wherein the lowering comprises engaging a stop ring circumferentially disposed about the interior surface of the sleeve with a top surface of the pipe.

20. The method of claim 16, comprising decoupling the shaft from the sleeve to facilitate removal of the shaft from the pipe.

21. The method of claim 16, wherein two of the steps are performed simultaneously at least in part.

22. The method of claim 16, wherein the steps are performed in the order listed.

* * * * *